United States Patent [19]

Panetti

[11] Patent Number: 4,905,422

[45] Date of Patent: Mar. 6, 1990

[54] METHOD AND DEVICE FOR THE CONTINUOUS RECTIFICATION OF THE RAILS OF A RAILWAY TRACK

[75] Inventor: Romolo Panetti, Geneva, Switzerland

[73] Assignee: Speno International S.A., Geneva, Switzerland

[21] Appl. No.: 647,694

[22] Filed: Sep. 5, 1984

[30] Foreign Application Priority Data

Sep. 16, 1983 [CH] Switzerland ..... 5052/83

[51] Int. Cl.[4] ..... E01B 31/17

[52] U.S. Cl. ..... 51/178; 51/165.71

[58] Field of Search ..... 51/178, 165.71; 364/474

[56] References Cited

FOREIGN PATENT DOCUMENTS 2333897 7/1977 France .
2405329 5/1979 France .
592780 11/1977 Switzerland .
611365 5/1979 Switzerland .

*Primary Examiner*—Roscoe V. Parker
*Attorney, Agent, or Firm*—Young & Thompson

[57] ABSTRACT

One displaces along the railway track at least one assembly of grinding units (13,14,15), angularly displaced the ones with respect to the others. One controls the pressure with which each grinding unit (13,14,15) is applied against the rail (12) in function of at least one parameter of a polygon (6) cirrcumscribing to a reference profile and the sides of which are parallel to the active surfaces of the corresponding grinding wheels (14) of the grinding units. The apparatus comprises grinding (13,14,15) angularly displacable on a carriage (11) guided along a rail (12). For each unit (13,14,15) it comprises at least one control circuit (19,20,21) defining, in function of a parameter of a polygon (6) circumscribing to a reference profile and the sides of which are parallel to the active surfaces of the grinding wheels (14) of the corresponding unit, the inclination of the unit and at least one control circuit (23,24,25) defining in function of at least one parameter of the polygon (6) the applying force with which the grinding wheel (14) is applied against the rail 12.

19 Claims, 4 Drawing Sheets

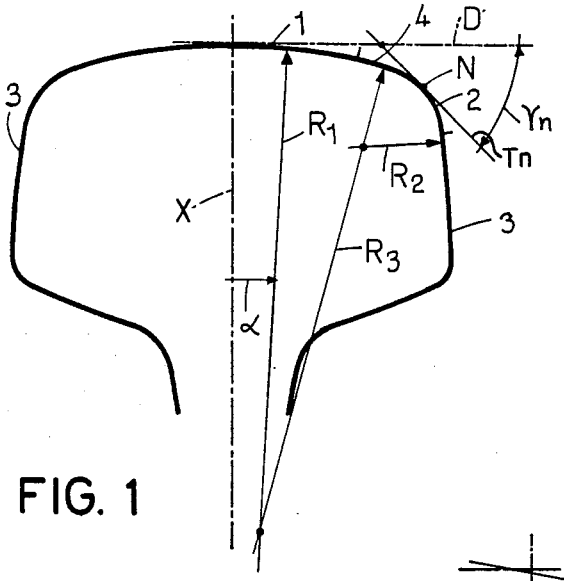
FIG. 1
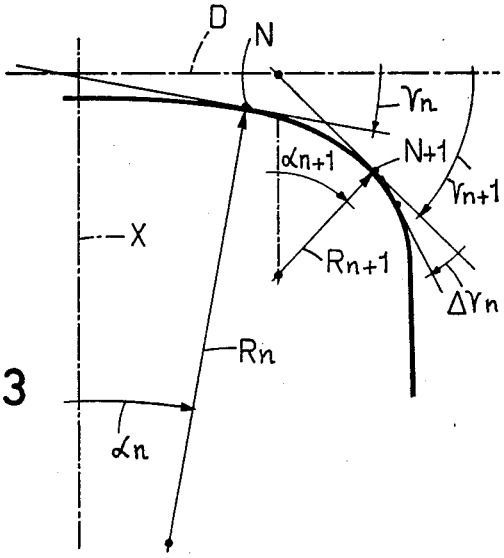
FIG. 3
FIG. 2
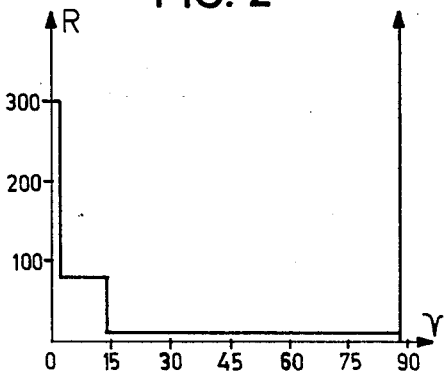
FIG. 4
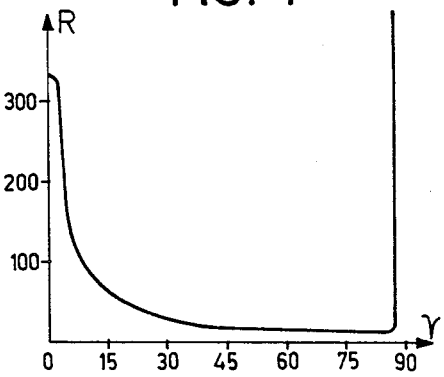

METHOD AND DEVICE FOR THE CONTINUOUS RECTIFICATION OF THE RAILS OF A RAILWAY TRACK

The transverse profiles of rails for railway tracks have been determinated by calculations and experimentation, they have been improved throughout the years to optimalise the requirements of a manufacture as easy as possible on the one hand and, on the other hand the requirements relating to the security and rolling comfort of the trains. The UIC has defined several transverse profiles for rails of which one of the most frequently used is the UIC 60, shown in FIG. 1, defining a symmetric transverse profile formed by three radii of curvature, a radius R1 of 300 mm forming the rolling table 1 of the rail or upper surface of the head of the rail, a radius R2 of 13 mm forming the inside or outside shoulders 2 of the rail connected to the lateral, approximately linear, sides 3 of the rails, and a third radius R3 of 80 mm forming the transition zones 4 between the rolling table 1 and the shoulders 2 of the rail.

Defining an angle $\gamma$ n as the angle comprised between a straight line D tangent to the profile of the head of the rail and perpendicular to the vertical axis of symmetry x of the rail and the tangent Tn to the profile of the head of the rail at point N; it is possible to graphically represent the transverse profile of the rail by plotting for each point of the profile as the ordinate the radius of curvature of the rail and as the abscissa the angle $\gamma$. For the standard UIC 60 profile this graphical representation is given in FIG. 2.

The profiles of the wheel tires of the railway vehicles have also been determined by calculation and experimentation. The profiles of the rail and of the tires are conjugated profiles.

Due to the passage of the trains on the rails of the railway tracks, the profiles of the rails and of the wheels wear off and are modified. The worn wheels passing on a new rail profile deform it progressively and give it an "average wearing off profile" which is different from the "original profile" but still can be considered in certain cases as satisfactory as well from the safety point of view as from the comfort point of view of the trains. This "average wearing off profile" which is satisfactory is characterized by the fact that the three original radii of curvature of the profile have been replaced by a multitude of radii of curvature which can also be graphically represented as $R=f(\gamma)$, $\gamma$ being always defined as above. This representation of this average wearing off profile is given in FIG. 4, the profile itself being shown in FIG. 3.

Under the effect of the heavy loads and above all of the dynamic loads, an ondulatory wearing is progressively formed as well as an important deterioration of the average wearing off profile, burrs of more or less importance can be formed.

To enable a longer use of the rails one reprofiles the rails particularly by grinding which is on; operation which aims to give to the rail a correct transverse profile again. Up to now one has tried to give to the rail its original profile again, see patent CH 611,365, and this necessitates often an important removal of material depending on the deformation of the rail to be ground.

A method for reprofiling by grinding is described in the patent CH 592,780 according to which one moves continuously along the rails several grinding units, forming angles between them and therefore grinding different side lines of the rail, of which the pressure is adjusted and thus the cutting depth, as a function of the differences existing for each side line concerned between the original profile and the real profile of the rail.

This method is well adapted for the first coarse reprofiling passes, but necessitates thereafter a large number of finishing passes to come close to the original profile to be recreated. These finishing operations are time consuming and costly. Furthermore in this method the side lines of the rail to be ground are purely arbitrarily determined by the grinding workers and therefore it is of course not possible to obtain the best possible reprofiling.

If one applies a lapidary grinding wheel with a given force against the portion of the head of the rail having a radius of curvature R1 of 300 mm the cutting depth will be small and the width of the face produced will be great. If the same grinding wheel acts with the same pressure on the portion of the head of the rail having a radius of curvature R2 of 13 mm the width of the face will be much less, but the cutting depth will be greater. There is thus an interdependency between the width of the face ground and the desired cutting depth and the radius of curvature and the already known method mentioned which does not take into account the desired cutting depth to adjust the working pressure of the grinding wheels, is not adapted to finish the reprofiling. To obviate to these drawbacks, the working pressure of the grinding wheels is adjusted arbitrarily at the judgement of the grinding worker, but this can also not lead to an optimum reprofiling.

Practice has shown that when a rail had been reprofiled to a shape close to its original profile it takes very soon, due to the passage of the worn wheels of the trains, and without damage for the railway traffic, an average wearing off profile which is satisfactory.

The traffic at high speed necessitates a very good grinding finish, this particularly in the zone of the rail shoulder where the relative angular position of the faces as well as their width have a determined importance for the guiding of the trains and to avoid any risk of derailment. The known methods, as has been seen depend depending entirely on human appreciations for the positionning of the grinding wheels as well as for their working pressures against the rail. They do not permit obtaining always the desired reprofiling quality and are therefore only better than nothing.

Taking into account the observations mentioned hereabove and the drawbacks of the existing reprofiling methods, the present invention has for its object a method and a device for the continuous rectification of the rails of a railroad track, particularly for the finishing passes of the reprofiling of rails such as defined in the independent claims of the present patent.

The attached drawing shows schematically and by way of example representations of transverse profiles of rails, a scheme explaining the reprofiling principle of the present invention, a simplified representation of a device to carry out the method according to the invention and a practical example of a reprofiled rail.

FIG. 1 shows in crossection the profile of the head of a rail at the standard UIC 60.

FIG. 2 is a graphical representation $R=f(\gamma)$ of the profile shown in FIG. 1.

FIG. 3 shows a partial crossection of an average wearing off profile of a rail.

FIG. 4 is a graphical representation $R=f(\gamma)$ of the profile shown in FIG. 3.

Figure 5:
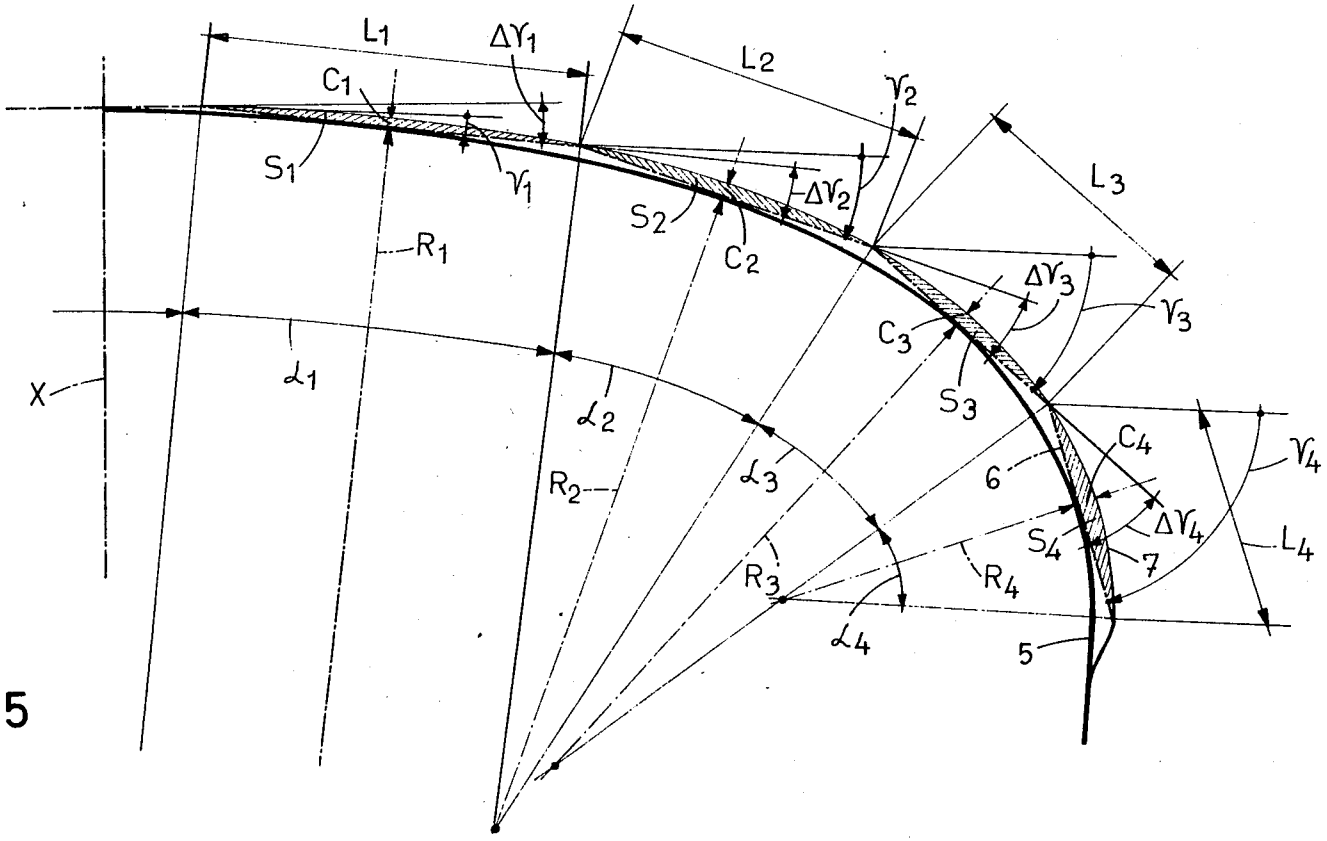
FIG. 5 is a principle scheme showing the finishing reprofiling method according to the invention.
Figure 6:
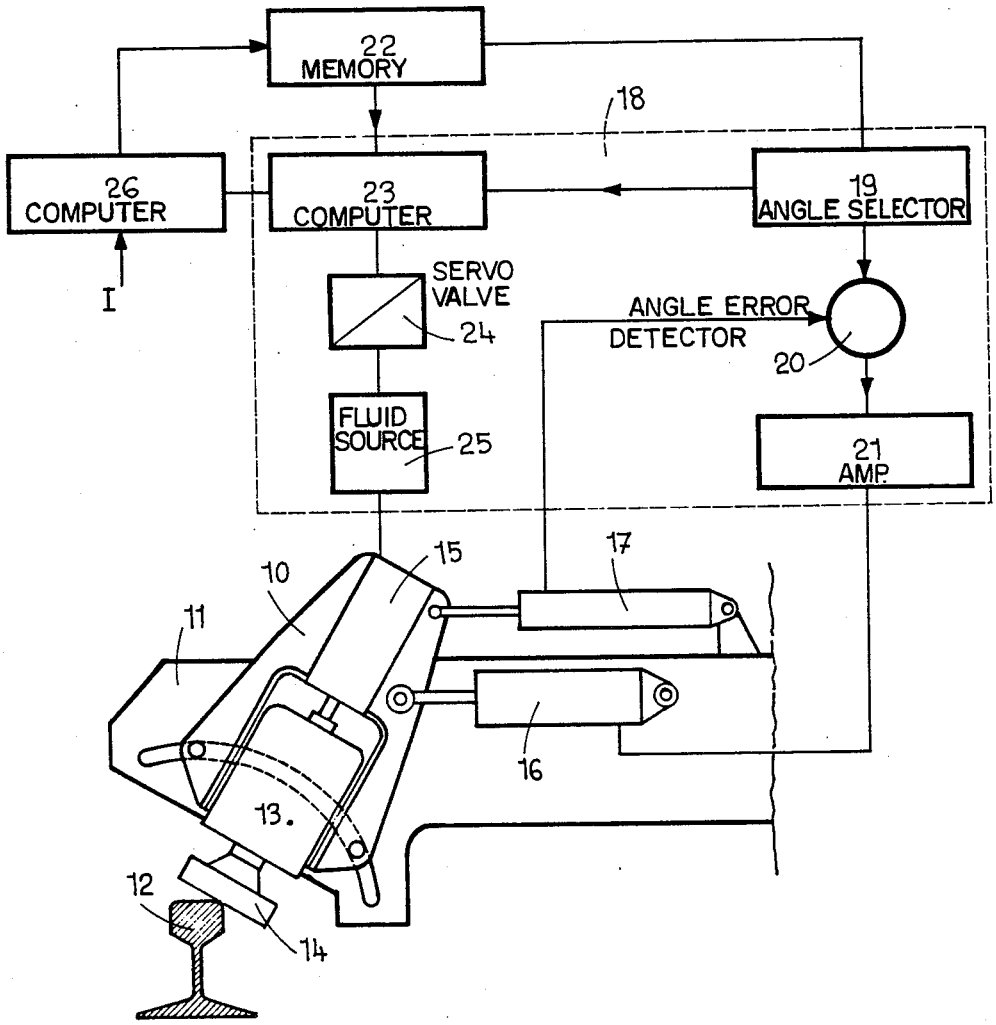
FIG. 6 is a diagram showing a simplified embodiment of a reprofiling device according to the present invention.

The present method relates to the continuous on track reprofiling of the rails of a railroad track by means of grinding tools mounted on carriages rolling on the rails and connected to a railway vehicle by means of members providing for their displacement along the rails and their applying against said rails.

Starting from the observation that a rail which is reprofiled to its original profile or a new rail deforms itself very rapidly under the rolling of the trains to reach an average wearing off profile and that once this first wearing off is done, the subsequent deformations of the profile, rendering the rail unusable takes much more time to form; and knowing that the reprofiling to the original profile of a rail is an operation necessitating a great number of finishing passes so that this work is long and onerous, the process of the invention performs the reprofiling of the rail to its average wearing off profile and not to its original profile and this has up to now never been done.

Practice has shown that thanks to this new process, the reprofiling of rails, to an average wearing off profile which is satisfactory, used as reference profile, can be performed more quickly and with fewer working passes.

Furthermore the invention avoids the uncertainties and arbitrary adjustments relative to the positioning of the grinding wheels as wells as to their working pressure by defining an exact method for the determination of these parameters.

The first operation of the present method is to define for a section of the railway network to be reprofiled a satisfactory average wearing off profile. It is this average profile which is then used as reference profile for the finishing of the reprofiling of the rail.

This average wearing off profile or reference profile is represented for example in FIG. 3 and it is characterized by the fact that for each of its points N, N+1 . . . it has a different radius of curvature Rn, Rn+1. The shape of this profile can be graphically represented in FIG. 4 by plotting the function $Rn=f(\gamma n)$ where $\gamma n$ is the angle which a tangent to the profile at point N forms with a tangent to said profile extending perpendicularly to the symmetry axis or to the longitudinal plane of the rail.

When the average wearing off profile used for the reprofiling is defined, the second step of the present method consists in defining a polygon circumscribing this reference profile. This polygon or better at least one of its parameters, such as the number of its faces n, the angle at the center $\alpha$ between the faces, the angle comprised between two faces $\Delta\gamma$, the width of the faces L, is determined in function of the quality of the desired finishing of the reprofiling. For the determination of the polygon, the values of n, $\Delta\gamma$or L can be defined by functions $n=f(R)$; $\Delta\gamma=(R)$ or $L=f(R)$; these values need not to be constant.

In a general way the polygon circumscribing the reference profile is clearly defined on the one hand by the said profile and on the other hand by a parameter of the polygon itself defined in function of the desired precision of the reprofiling particularly the number of sides, the angle between sides, etc.

The third operation of the present method consists to position the grinding units in such a way that the active surface of each grinding wheel extends parallely or tangentially to a side of the polygon just defined.

Finally the fourth operation of the present method consists in adjusting the pressure of each grinding unit against the rail in function of at least one parameter of the side of the polygon to which it is associated.

In a simplified version of the method according to the invention the inclination of the axes of the grinding units with respect to the plane of symmetry of the rail is, as usually, only determined approximatively by the grinding workers. This setting of the angular position of the grinding units being made, each grinding wheel is located on one side of a polygon circumscribing the rail.

Knowing this circumscribing polygon, the working pressure of each grinding wheel is determined in function of one or more parameters of this polygon, and not arbitrarily as up to now.

Even this simplified version of the method brings an important technical advance since the determination of the working pressure of the grinding wheels against the rail is practically impossible to make only by appreciation.

FIG. 5 shows very schematically the original basic principle of the method according to the present invention. In this figure one has represented a portion of the average wearing off profile 5 serving as reference profile for a section of a railroad track to be reprofiled. The broken line 6 materialises the polygon circumscribing the reference profile 5 comprising in the example shown four faces for each side of the rail covering the rolling table, the intermediate zone and the rail shoulder. The number of faces or sides of this polygon is determined in function of the required precision of the finishing reprofiling. In reality this polygon could have eight faces covering the whole profile of the head of the rail. The greater the number of faces, the greater is the reprofiling precision, but the greater the number of grinding tools the greater is the number of working passes.

This polygon circumscribing the reference profile can be determined by other parameters than its number of sides. For example it is possible to provide that the angle between the faces $\Delta\gamma$be constant, or vary in function of the radius of curvature of the reference profile. It is also possible to provide that the length of the sides L of this polygon be constant or a function of the radius of curvature of the reference profile.

The line 7 shows schematically the real profile of the head of the rail which is to be reprofiled.

In the case shown, the number n of faces covering the active portion of the rail profile is $n=4$ symmetrically distributed with respect to the vertical axis x of the rail. To each face corresponds a face width L1, L2, L3, L4; an angle $\gamma 1$, $\gamma 2$, $\gamma 3$, $\gamma 4$ which that face makes with a straight line tangent to the reference profile 5 and perpendicular to the axis x; an angle $\Delta\gamma 1$, $\Delta\gamma 2$, $\gamma\Delta 3$, $\Delta\gamma 4$ which the given face makes with the adjacent face located on the side of the axis x of the rail, a mean radius of curvature R1, R2, R3, R4; an angle to the center $\alpha 1$, $\alpha 2$, $\alpha 3$, $\alpha 4$; a cutting depth C1, C2, C3, C4, representing the distance separating, at the middle point of a given side, the real profile 7 from the side of the polygon 6; and finally a cross-hatched surface S1, S2, S3 and S4 representing in crossection the quantity of metal to be taken off to pass from the real profile 7 to the desired reprofiled profile shown by the polygon 6.

The choice of the circumscribed polygon depending on the quality or finish of the desired reprofiling one can for example during the first finishing passes define a polygon the area of the surfaces S of which would be constant and equal to a maximum value. Thus at the beginning of the finishing one would take off the maximum of metal for each pass. On the contrary at the end of the finishing it is necessary that the circumbscribed polygon, which finally corresponds to the profile of the reprofiled rail, be adjusted as close by as possible to the reference profile 5 and that it is a polygon wherein the angle between the faces is constant or a function of the radius of curvature R which will be preferred. A definition of the polygon which is generally well adapted to the practical cases is the one where the angle between the faces $\Delta\gamma$ is proportional to the curvature of the reference profile $\Delta\gamma = K\cdot(1/R)$.

It is evident that the polygon, determined in function of the required reprofiling quality, can be circumscribed to the original profile or to the real profile of the rail instead to its average wearing off profile; this leads however generally to a greater number of finishing passes.

In a general way the essence of the present method of reprofiling a rail consists in displacing along a line of rails of a railroad track, an assembly of grinding units of the rail, angularly displaced the ones with respect to the others and controlling the pressure with which each of these grinding units is applied against the rail in function of at least one parameter of a polygon circumscribing a reference profile and the sides of which are parallel to the active surfaces of the grinding wheels of the grinding units.

It is to be noted that if the reprofiling vehicle comprises only a limited number of grinding units, several passes can be necessary to reprofile the entire rail profile, the units working during each pass on different side lines of the rail.

The pressure which applies each grinding unit against the rail is thus a function on the one hand of the position of the corresponding face with respect to the symmetry axis of the rail, that is a function of the angular displacement $\gamma$ of the grinding unit with respect to said symmetry axis of the rail, generally approximately vertical; and on the other hand this pressure is also a function of the width L of the corresponding side or of the desired cutting depth C for example or of a combination of these parameters. It can also be a function of the cross sectional area of the metal to be taken off.

For the obtention of a higher reprofiling precision, the method provides further that the polygon or certain of its parameters be defined in function of the desired reprofiling quality, the said polygon is defined as being a polygon circumscribing the profile which shall be reconstituted that is the original profile or still better the average wearing off profile of the rail, even though in the simplified method it can circumscribe the real profile of the worn rail.

The device to carry out the described method comprises an assembly of grinding units 10 carried by a carriage 11 guided by the rail 12, comprising each a motor 13 to drive a lapidary grinding wheel 14 in rotation. A jack 15 is provided to apply the grinding wheel 14 against the rail with a determined force. Each unit 10 is angularly displacable with respect to the carriage 11 and therefore with respect to the other grinding units carried by this carriage 11.

Each grinding unit comprises further a motor 16 controlling the inclination of said unit with respect to the carriage and a sensor 17 measuring the angle of inclination of said unit 10 with respect to the carriage 11.

Each grinding unit is controlled by a control circuit 18 comprising on the one hand a servo-mechanism of the inclination of the unit and on the other hand a servo-mechanism of the force applying the grinding wheel 14 against the rail 12.

The servo-mechanism of the inclination of the grinding unit 10 comprises an angle selector 19 fed by a memory 22 containing the parameters of the polygon, particularly the angular position of its faces, and selects for each grinding unit the face of the polygon to which the active face of the grinding wheel has to be parallel and thus the degree of inclination of the grinding unit 11 with respect to the carriage 12. The signal delivered by this selector 19 feeds a first input of an angle error detector 20 the other input y which is fed by the output of the sensor 17. As soon as a difference is detected between the input of the error detector 20, the said detector delivers a signal to the amplifier 21 which controls the motor 16.

The servo-mechanism of the pressure applying the grinding wheels 14 against the rail 12 comprises a computer 23 fed by the memory 22 and the selector of inclination 19. This computer determines in function of at least one parameter of the polygon stored in 22 and if necessary according to the inclination angle of the unit, a control value which is delivered to a servo-valve 24 controlling the feeding of the jack 15 through a source of fluid 25.

A computer 26 having in its memory information relating to the reference profile determined by the desired reprofiling quality, determines the parameters of the polygon in function of the said profile and of information I defining the desired finishing quality. These parameters or characteristics of the polygon are stored in 22.

Figure 7:
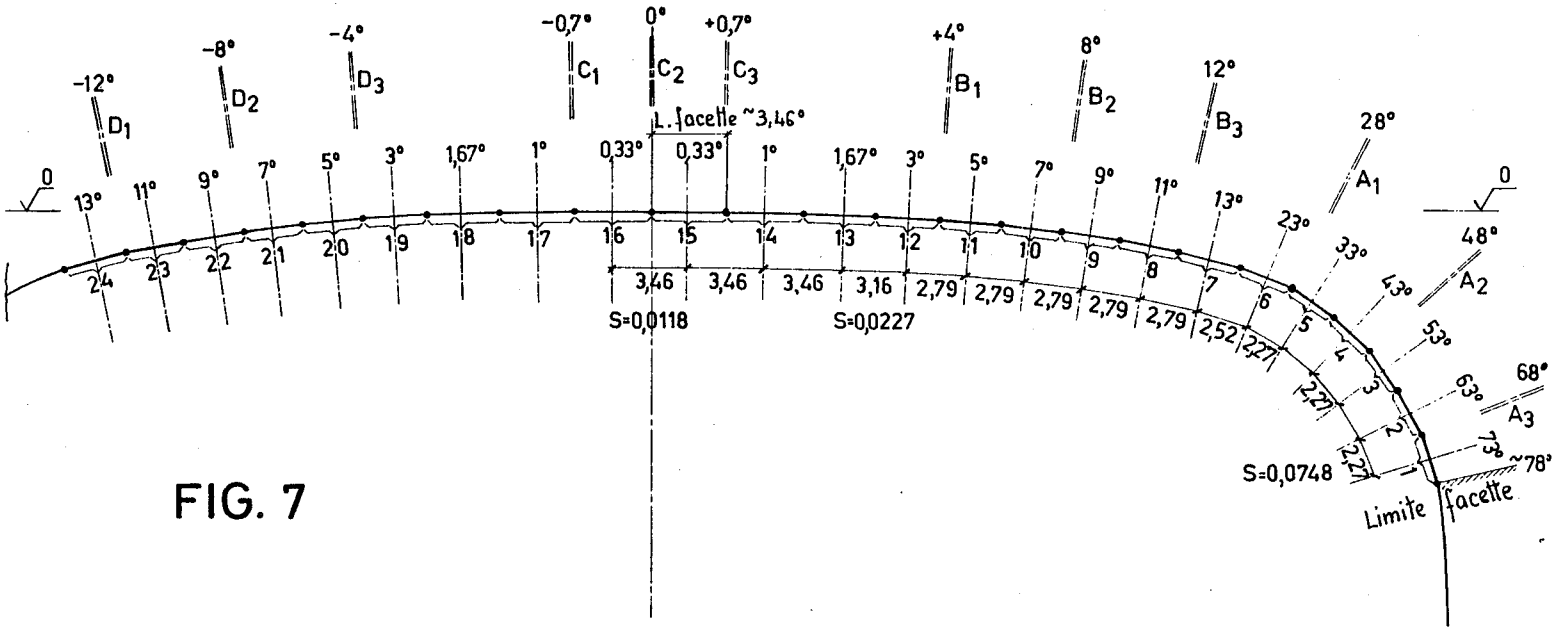
FIG. 7 shows one practical example of the reprofiling of a rail by means of a device comprising four pairs of grinding wheels.

FIG. 7 shows a polygon circumscribing the desired reference profile comprising 24 grinding faces or sides of the polygon distributed over the rolling surface of the rail, its inside shoulder and the rolling zone between these two portions. This polygon circumscribing the reference profile is determined in function of the desired reprofiling quality, in this particular case the width of the grinding faces, that is the length of the sides of the polygon, in function of the radius of curvature of the reference profile. Therefore, in the case shown the width of the side of the polygon centered on the vertical axis of the rail is 3.46 mm, as well as the next face. The third face from said axis of the rail has a width of 3.16 mm the 4,5,6,7 and 8th faces a width of 2.79 mm, the ninth a width of 2.52 mm and the others a width of 2.27 mm.

This corresponds to taking off surface metal of $S = 0.0118\ mm^2$ for the first faces, $S = 0.0227\ mm^2$ for the faces of a width of 2.79 and $0.0748\ mm^2$ for the faces of a width of 2.27 mm.

To reprofile a rail along such a polygon one uses a machine comprising four carriages A,B,C,D each carrying two grinding units. The grinding units of a carriage A are angularly displaced by 10° the one with respect to the others, whereas the grinding units of the three other carriages B,C,D are displaced the ones with respect to the others by 2°.

The finishing reprofiling is done in three successive passes during which the four carriages are set in different angular positions with respect to the rail.

In a first pass, with respect to the longitudinal plane of the rail the carriage A is displaced by 28°, the carriage B by 4°, the carriage C by −0.7° and the carriage D by −12°. During this machining pass sides 6,5; 11,12; 18,15 and 23,24 are reprofiled. In a second machining pass the carriage A is displaced by 48°, the carriage B by 8°, the carriage C by 0° and the carriage D by −8°. The sides 3,4; 9,10; 14,17 and 21,22 are reprofiled.

Finally in a third machining pass the carriage A is displaced by 68°, the carriage B by 12°, the carriage C by 0.7° and the carriage D by −4° and the sides 1,2; 7,8; 13,15 and 19,20 are reprofiled.

The grinding pressure that is the pressure of each grinding wheel against the rail, is in this particular case a function of a the angle $\gamma$ of the side of the polygon and of its width L. Therefore with a compact machine having a limited number of grinding units the profile of the rail is rectified in three successive finishing passes.

In this example one determines a polygon circumscribing the reference profile the width of the sides of which is a function of the radius of curvature of the reference profile; then one places the grinding wheel parallely to the sides of this polygon, the pressure of each grinding wheel against the rail being determined in function of the angle of the corresponding side of the polygon and of its width so that the surface of metal to be taken off S corresponding to each side of the polygon will be effectively ground off.

In such an example each grinding unit comprises two motors driving each one grinding wheel. Each unit comprises thus a pair of grinding wheels applied against the rail with a same force given by the common applying means to the grinding unit.

It is evident that the relative angular position of the axis of rotation of the grinding wheels of a same unit can be fixed or adjustable.

I claim:

1. A method for the continuous on-track reprofiling of a rail of a railway track, comprising determining a predetermined curve to which it is desired to grind a surface of said track, circumscribing a polygon about said curve with a plurality of sides of said polygon tangent to said curve, moving along the track an assembly of grinding units each of which includes a power driven rotary grinding wheel that has a rectilinear grinding surface as viewed in a direction lengthwise of the rail, positioning each grinding wheel with said surface parallel to a respective said side of said polygon, and rotating and pressing said grinding wheels against said rail with a pressure whose magnitude is determined by at least one parameter of said polygon.

2. A method according to claim 1, in which said curve is the original transverse profile of the rail.

3. A method according to claim 1, in which said curve is an average wearing-off transverse profile of the head of the rail.

4. A method according to claim 1, wherein the angle between adjacent said sides of the polygon is constant.

5. A method according to claim 1, in which the complement of the angle between adjacent said sides of the polygon varies inversely as the radius of said curve between the points of tangency of said adjacent sides.

6. A method according to claim 1, wherein the length of the sides of said polygon is constant.

7. A method according to claim 1, wherein the length of the sides of the polygon varies directly as the radius of said curve at the points of tangency of the curve with said sides.

8. A method according to claim 1, wherein said at least one parameter comprises the angle between a said side and the horizontal.

9. A method according to claim 1, in which said sides of the polygon are of unequal length and said at least one parameter comprises the length of said sides.

10. Device for the continuous on-track reprofiling of a rail of a railway track, comprising a carriage movable along the rail, a plurality of grinding units, each grinding unit having a rotatable grinding wheel having a rectilinear grinding surface as viewed in a direction lengthwise of the rail, means for individually positioning said grinding units on the carriage such that said rectilinear surfaces of said grinding wheels lie parallel to respective sides of a polygon which circumscribes and whose sides are tangent to a predetermined curve to which it is desired to reprofile the rail, means for rotating said grinding wheels, means for pressing said grinding wheels against the rail, and means regulating the force with which each grinding wheel presses against the rail as a function of at least one parameter of said polygon.

11. A device according to claim 10, further comprising a memory storing the characteristics of said polygon, and a computer which retrieves data from said memory and which delivers signals that control the inclination of the grinding wheels and the force with which they are applied against the rail.

12. A method according to claim 10, in which said curve is the original transverse profile of the rail.

13. A method according to claim 10, in which said curve is an average wearing-off transverse profile of the head of the rail.

14. A method according to claim 10, wherein the angle between adjacent said sides of the polygon is constant.

15. A method according to claim 10,in which the complement of the angle between adjacent sides of the polygon varies inversely as the radius of said curve between the points of tangency of said adjacent sides.

16. A method according to claim 10, wherein the length of the sides of said polygon is constant.

17. A method according to claim 10, wherein the length of the sides of the polygon varies directly as the radius of said curve at the points of tangency of the curve with said sides.

18. A method according to claim 10, wherein said at least one parameter comprises the angle between a said side and the horizontal.

19. A method according to claim 10, in which said sides of the polygon are of unequal length and said at least one parameter comprises the lengths of said sides.

* * * * *